US008380345B2

(12) United States Patent
Junker et al.

(10) Patent No.: US 8,380,345 B2
(45) Date of Patent: Feb. 19, 2013

(54) METHOD FOR CONTROLLING LONGWALL OPERATIONS WITH INCORPORATION OF AIR-TECHNOLOGY AND CLIMATE-TECHNOLOGY RESOURCES

(75) Inventors: Martin Junker, Rheinberg (DE); Walter Hermülheim, Hagen (DE); Detlef Rother, Bottrop (DE); Armin Friederich, Dinslaken (DE)

(73) Assignee: RAG Aktiengesselschaft (DE)

( * ) Notice: Subject to any disclaimer, the term of this patent is extended or adjusted under 35 U.S.C. 154(b) by 170 days.

(21) Appl. No.: 12/918,478

(22) PCT Filed: Feb. 19, 2008

(86) PCT No.: PCT/EP2008/001267

§ 371 (c)(1),
(2), (4) Date: Aug. 19, 2010

(87) PCT Pub. No.: WO2009/103308

PCT Pub. Date: Aug. 27, 2009

(65) Prior Publication Data

US 2011/0029138 A1 Feb. 3, 2011

(51) Int. Cl.
*G06F 19/00* (2006.01)

(52) U.S. Cl. ..... 700/230; 299/1.5

(58) Field of Classification Search ..... 700/230; 299/1.5, 1.8, 1.9; 198/502.1
See application file for complete search history.

(56) References Cited

U.S. PATENT DOCUMENTS

| | | | | | |
|---|---|---|---|---|---|
| 4,015,124 | A | * | 3/1977 | Page | 378/45 |
| 4,189,183 | A | * | 2/1980 | Borowski | 299/1.6 |
| 4,212,382 | A | * | 7/1980 | Williams | 198/502.2 |
| 4,763,484 | A | | 8/1988 | Osenberg | |
| 4,952,000 | A | * | 8/1990 | Lipinski et al. | 299/1.6 |
| 4,968,098 | A | * | 11/1990 | Hirsch et al. | 299/1.1 |
| 5,090,775 | A | * | 2/1992 | Berger | 299/1.05 |
| 5,193,883 | A | | 3/1993 | Spies | |
| 5,709,433 | A | * | 1/1998 | Christopher et al. | 299/30 |

FOREIGN PATENT DOCUMENTS

| | | |
|---|---|---|
| DE | 3729410 | 3/1989 |
| DE | 40 40 345 C1 | 4/1992 |
| DE | 10330387 | 7/2004 |
| GB | 2325261 | 11/1998 |

* cited by examiner

*Primary Examiner* — Kidest Bahta
(74) *Attorney, Agent, or Firm* — Robert Becker; Becker & Stachniak, P.C.

(57) ABSTRACT

A method for controlling the extraction capacity of longwall operations in underground coal mining, including ascertaining the respective demand of the longwall operations, for air-technology and climate-technology resources, as influencing variables for a projected delivery quantity on the basis of data applicable to equipment of the longwall operations and to mineral deposit parameters, and storing the ascertained influencing variables in a computer as target data. Actual data for a raw coal delivery quantity, for air flowing through, for the supplied cooling capacity, and for the exhaust gas during running operation is detected and conveyed to the computer. If an increased demand for resources is recognized, coverage is initiated via a changeover of excess resources available at other longwall operations or, if a reduced demand for resources is recognized, excess resources are rerouted to other longwall operations experiencing corresponding demand deficiencies.

12 Claims, No Drawings

METHOD FOR CONTROLLING LONGWALL OPERATIONS WITH INCORPORATION OF AIR-TECHNOLOGY AND CLIMATE-TECHNOLOGY RESOURCES

BACKGROUND OF THE INVENTION

The instant application should be granted the priority date of Feb. 19, 2008 the filing date of the corresponding International patent application PCT/EP2008/001267.

The invention relates to a method for controlling the extraction capacity of longwall operations performed in underground coal mining, both a single longwall operation and also in a linkage of multiple longwall operations performed in a connected mine structure.

In operations of underground coal mining, the problem exists in general of optimum exploitation of the installed extraction capacity of both individual longwall operations and also multiple longwall operations in sum. The air-technology and climate-technology resources to be supplied to an individual longwall operation for the optimum capacity development represent a limitation or restriction of the extraction capacity. These air-technology and climate-technology resources essentially comprise the influencing variables of the fresh air to be supplied to a longwall operation, the cooling capacity to be available from employed cooling systems, and the equipped gas exhaust, the above-mentioned influencing variables partially mutually influencing one another. Thus, the air speed cannot exceed values of 4 m/s in the longwall operations and 6 m/s in the roads, whereby the quantity of air to be conducted through is limited as a function of the particular available cross-sections. The rock temperature and the installed, preferably electrical power essentially determine the need for cooling capacity to be available in order to ensure a climate which is still physiologically acceptable for the operating personnel, and finally a limiting value of 1% or 1.5% of methane in the air flow is to be ensured, exceeding which causes automatic operating shutdowns. The methane concentration is in turn also a function of the quantity of air conducted through as a dilution factor and can further be influenced or controlled by the operation of a gas exhaust, whose effectiveness is also in turn a function of the configuration and the status of gas exhaust boreholes.

The invention is therefore based on the object of specifying a method of the type cited at the beginning, using which the most optimum possible exploitation of the extraction capacity of longwall operations of underground coal mining may be implemented.

SUMMARY OF THE INVENTION

The achievement of this object, including advantageous embodiments and refinements of the invention, results from the content of the patent claims which are appended to this description.

For this purpose, the invention provides a method, in which the demand of the particular longwall operation for air-technology and climate-technology resources on the basis of air to be supplied, cooling capacity to be available of employed cooling systems, and gas exhaust to be equipped as influencing variables for a target delivery quantity of a longwall operation is ascertained in the form of target data to be stored in a computer unit, on the basis of data applicable for the machine equipment of the longwall operations and for the mineral deposit data applicable for the extraction areas to be traveled through by the particular longwall operations, and the actual data for the raw coal delivery quantity and for the air to flow through the particular longwall operation, for the particular supplied cooling capacity, and for the gas exhaust are acquired using installed sensors and supplied to the computer unit during the running operation at the individual longwall operations, and, if an increased demand for air-technology and climate-technology resources is recognized, the demand coverage is initiated via a changeover of excess resources available at other longwall operations and, if a reduced demand is recognized, excess resources are rerouted to other longwall operations having corresponding demand gaps.

Accordingly, initially in a first phase the target data for the air-technology and climate-technology supply of a planned longwall operation are ascertained at an assumed planned delivery quantity. Starting from the planned cross-sections, the installed capacity, the outgassing behavior of the seam to be extracted in, and the prevailing rock temperature, outgassing and climate predictions are performed as a function of the planned extraction capacity, technical feasibility limits and maximum permissible air speeds, maximum possible cooler dimensions in relation to the longwall and road dimensions, maximum economically feasible cold water mass flows, and a maximum partial vacuum which can be implemented in the gas exhaust being considered. The ability to implement the supply on the basis of the available resources in the mine structure in consideration of the supply of further operations is also to be considered.

If the actual values with respect to the listed influencing variables for the air-technology and climate-technology resources are detected continuously and in real time in later operation using corresponding sensors installed in the longwall operation and compared in an appropriately equipped computer unit to the target value stored therein, it is firstly to be ascertained for the individual longwall operation whether there is an increased demand for air-technology and climate-technology resources to achieve a specified raw coal delivery quantity which can be technically implemented, or whether the available air-technology and climate-technology resources will not be exhausted upon implementation of the current raw coal delivery quantity, so that a certain excess is available. Both increased demand and also reduced demand of individual longwall operations may be balanced out over multiple longwall operations in an automated sequence by corresponding activation on the part of the computer unit, so that the advantage of capacity optimization with respect to the extraction capacities of an entire mine is possible using the invention. Individual influencing variables such as air quantity, cooling capacity, and gas exhaust may also be regulated for individual longwall operations and also over multiple longwall operations.

According to an exemplary embodiment of the invention, it is provided that the influencing variables for the air-technology and climate-technology resources are monitored individually in the context of target/actual analyses in the computer unit and an automatic readjustment of the relevant influencing variable is performed before reaching a set limiting value for an individual limiting variable.

In the context of the application of the method according to the invention, it can be provided that a priority list for automatically changing the supply of individual longwall operations with air-technology and climate-technology resources is stored in the computer unit, which controls a plurality of longwall operations; the priority list can be parameterized freely as a function of the actual state of the individual longwall operations connected to a corresponding supply compensation.

According to one exemplary embodiment of the invention, it is provided that the incoming actual data is subjected in the computer unit to a plausibility check for exceeding typical data deviations and an error message is generated upon the existence of such deviations. The case can thus occur that one or more sensors fail or display significantly deviating signal variables within a short transmission interval. In such cases, it can be ascertained in the computer unit whether the values transmitted by the sensors lie in the scope of predefined limits. If a system-relevant disturbance variable exists, the system error can be logged and displayed. Furthermore, it is possible to store a priority list in the computer unit for the existence of system-relevant disturbance variables, as to whether upstream or downstream sensors may be used for mapping a control unit for the resource ascertainment. If this is possible, the computer unit can follow the typical sequence.

Specifically, according to one exemplary embodiment of the invention, it can be provided that the airspeed is monitored at individual points in the longwall operations and/or the downstream roads.

This also applies correspondingly for the monitoring of the cooling capacity, in which, for example, the throughput of cold water or the cold water flow temperature and/or the cold water recirculation temperature is monitored. Monitoring of the running capacity of the fans used on the cooling devices can also be provided.

Furthermore, it can be provided that the concentration of methane in the air flow is monitored, as well as the partial vacuum applied at a gas collection line and also the volume flow exhausted via a gas collection line and/or the methane concentration in the gas exhaust.

The particular ascertained actual data give an indication of the particular current consumption of air-technology and climate-technology resources, which is to be related to the corresponding target data stored in the computer unit. Corresponding changes during the supply of individual operations with air-technology and climate-technology resources can be initiated in automated form from the target-actual comparison.

In the context of one exemplary embodiment, at least multiple longwall operations are to be in operation in the mine structure of a mine having a central refrigeration system and a central gas exhaust. According to one exemplary embodiment of the invention, it is assumed that a longwall A produces a raw coal delivery flow, which is detected by measuring technology, in the magnitude of its planned delivery quantity, which is typically set below the technically possible production maximum. Sensors acquire the concentration of methane gas at various points of the exhaust air flow, so that using the data ascertained therein, for example control variables M1, M2, M3, . . . may be recorded for the control of the air-technology and climate-technology resources. Furthermore, the partial vacuum applied to the gas collection line and also the methane concentration of the gas flow flowing out in the gas collection line are detected, as well as the air volume flows in the roads assigned to the longwall operation. As further control variables, the physical variables for estimating the climate summation values, which are ascertained in a way known per se, are also ascertained at selected locations as KLI1, KLI2, KLI3, . . . . The air volume flow required for the particular applicable operating state is regulated with the aid of an OR-linkage of the control variables M1, M2, M3 . . . or KLI1, KLI2, KLI3, . . . , depending on which control variable possibly first reaches a set limiting value. This regulation is performed on the basis of a suitable analysis of the regulation behavior, which is integrated in the system, in such a manner that it is prevented from exceeding a limiting value using an operational interruption possibly thus triggered.

In a further regulation step, for example partial vacuum and volume flow of the gas exhaust are then readjusted with respect to the optimum mixture composition for a following utilization of the exhausted methane, as long as the control variables for the control of the air-technology and climate-technology resources are not thus influenced.

During the regulatory interventions executed by the computer unit, a continuous change equalization is performed, in order to avoid overshooting interlocking regulatory processes. The rank of the control variables and their sequence and also a damping of the regulatory steps to be equipped are freely programmable in the above-described context. As a result, after completed regulation in the case of the current raw coal delivery of a longwall operation, specific non-exhausted air-technology and climate-technology resources remain, such as air volume flows or cold water volume flows, which are available in a further regulatory step, to be executed in the computer unit, for capacity optimization of other longwall operations in the mine.

Thus, free air-technology and climate-technology resources of the above-mentioned type are used for overall optimization of the extraction capacity of the mine. For this purpose, for example the cold water volume flows are automatically regulated so that firstly the basic requirements triggered by the particular operating state of the longwall operations are fulfilled as fully as possible in all running longwall operations of the mine. Specifications for the regulation behavior in the event of demand deviations upward or downward may be freely programmed in terms of a priority list. This can be expressed, for example, in a shutdown or reassignment of longwall mining operations or in a supply of excess cold water to operations which are climatically particularly demanding. This applies similarly for the air volume flows detected as the actual data. A reduction of the total air or cold water quantities in the case of a part load run by the overall mine system may also be represented using the method according to the invention, if technological reasons do not indicate a uniform load of the employed air or refrigerating machines.

In addition, an outgassing and climate prognosis, which is specific for a raw coal delivery flow, is prepared for the progressing extraction in the computer unit on the basis of the raw coal delivery flow, which is ascertained progressively in real-time, using which the target data initially stored in the planning stage in the computer unit are continuously updated as the specification for the actual control. These updated target values are correlated in the computer unit with the actually ascertained actual values. Differences established in this case may directly indicate a specific individual deviation as the cause of the difference. In the case of an individual deviation identified in this manner, for example an automatic disturbance correction can be initiated, such as automatic cleaning of a cooler upon dropping of the cold water recirculation temperature. If the established deviations indicate more complex causes, a checklist having notes and error messages can be prepared in the computer unit, on the basis of which regulation of the associated and also the superimposed control variables is performed. After completed regulation and possible reproduction of the target state, deviations which possibly still remain may be stored systematically in a databank of the computer unit and used for a regular recalibration of the employed prognostication of outgassing and climate behavior.

The features of the subject matter of this application disclosed in the above description, the claims, the abstract, and the drawing may be essential both individually and also in arbitrary combinations with one another for the implementation of the invention in its various embodiments.

The specification incorporates by reference the disclosure of International application PCT/EP2008/001267, filed Feb. 19, 2008.

The present invention is, of course, in no way restricted to the specific disclosure of the specification and drawings, but also encompasses any modifications within the scope of the appended claims.

The invention claimed is:

1. A method for controlling the extraction capacity of longwall operations in underground coal mining, including the steps of:

ascertaining the demand, of a respective one of the longwall operations, for air-technology and climate-technology resources, namely air to be supplied, cooling capacity to be made available from installed cooling facilities, and gas exhaust to be provided, as influencing variables for a projected delivery quantity of the longwall operation on the basis of data applicable to mechanical equipment of the longwall operations and to mineral deposit parameters applicable for the extraction areas through which respective ones of the longwall operations are to travel;

storing the ascertained influencing variables in a computer as target data;

by means of installed sensors, detecting actual data for a raw coal delivery quantity, for air flowing through the respective longwall operation, for the respectively supplied cooling capacity, and for the gas exhaust, during running operation at individual ones of said longwall operations;

conveying the detected actual data to the computer; and if an increased demand for air-technology and climate-technology resources is recognized based on the comparison of the actual data with the target data, initiating coverage of the increased demand via a changeover of excess resources available at other ones of the longwall operations, or, if a reduced demand for air-technology and climate-technology is recognized based on a comparison of the actual data with the target data, rerouting excess resources to other ones of the longwall operations that are experiencing corresponding demand deficiencies.

2. A method according to claim 1, which includes the further steps of individually monitoring the influencing variables for the air-technology and climate-technology resources in the computer unit in the context of target data/actual data analyses, and effecting an automatic readjustment of an individual influencing variable before a set limiting value of the relevant influencing variable is reached.

3. A method according to claim 1, which includes the further step of storing a priority list for an automated change of the supply of individual ones of the longwall operations with air-technology and climate-technology resources in the computer, which controls a plurality of longwall operations.

4. A method according to claim 1, which includes the further steps of subjecting incoming actual data in the computer to a plausibility check for an exceeding of typical data deviations, and upon the occurrence of deviations of this type, generating a malfunction message.

5. A method according to claim 1, which includes the further step of monitoring a respective air speed.

6. A method according to claim 1, which includes the further step of monitoring a respective throughput of cold water.

7. A method according to claim 1, which includes the further step of monitoring at least one of a respective cold water supply temperature and a respective cold water recirculation temperature.

8. A method according to claim 1, which includes the further step of monitoring a respective running performance of fans used on the cooling facilities.

9. A method according to claim 1, which includes the further step of monitoring the methane concentration in the air flow.

10. A method according to claim 1, which includes the further step of monitoring a partial vacuum applied to a gas collection line.

11. A method according to claim 1, which includes the further step of monitoring a volume flow exhausted via a gas collection line.

12. A method according to claim 1, which includes the further step of monitoring the methane concentration prevailing in the gas exhaust.

* * * * *